US007484444B2

(12) United States Patent
Tokumitsu

(10) Patent No.: US 7,484,444 B2
(45) Date of Patent: Feb. 3, 2009

(54) CUTTING DEVICE WITH A PAIR OF CUTTING BLADES AND ELEMENTS FOR DETECTING AND CONTROLLING WEAR OF THE CUTTING BLADES

(75) Inventor: Naoya Tokumitsu, Tokyo (JP)

(73) Assignee: Disco Corporation, Tokyo (JP)

( * ) Notice: Subject to any disclaimer, the term of this patent is extended or adjusted under 35 U.S.C. 154(b) by 36 days.

(21) Appl. No.: 11/046,801

(22) Filed: Feb. 1, 2005

(65) Prior Publication Data

US 2005/0166745 A1 Aug. 4, 2005

(30) Foreign Application Priority Data

Feb. 2, 2004 (JP) ..... 2004-025036

(51) Int. Cl.
*B26D 3/08* (2006.01)

(52) U.S. Cl. ..... 83/62.1; 83/72; 83/425.2; 83/884

(58) Field of Classification Search ..... 83/884, 83/881, 425.3, 62.1, 72, 74, 75, DIG. 1, 771, 83/425.2; 483/4–11; 700/169, 174, 175; 409/187, 194

See application file for complete search history.

(56) References Cited

U.S. PATENT DOCUMENTS 4,688,540 A * 8/1987 Ono ..... 125/13.01
5,353,551 A * 10/1994 Nishida ..... 451/5
5,842,461 A * 12/1998 Azuma ..... 125/13.01
6,024,631 A * 2/2000 Piper ..... 451/41
6,041,682 A * 3/2000 Jensen et al. ..... 83/13
6,102,023 A * 8/2000 Ishiwata et al. ..... 125/13.01
6,217,420 B1 * 4/2001 Stocker et al. ..... 451/43
6,332,834 B1 * 12/2001 Nukui et al. ..... 451/57
6,345,616 B1 2/2002 Umahashi
6,348,943 B1 * 2/2002 Huang et al. ..... 348/94
6,494,122 B2 * 12/2002 Kamigaki ..... 83/13
6,576,531 B2 * 6/2003 Peng et al. ..... 438/460
6,726,526 B2 4/2004 Sekiya et al.
6,761,615 B2 * 7/2004 Cohen ..... 451/6
6,767,615 B1 * 7/2004 Judkins et al. ..... 428/178
2004/0011176 A1 * 1/2004 Sekiya ..... 83/401

* cited by examiner

*Primary Examiner*—Boyer D. Ashley
*Assistant Examiner*—Laura M. Lee
(74) *Attorney, Agent, or Firm*—Smith, Gambrell & Russell, LLP

(57) ABSTRACT

A cutting device having a holding element for holding a workpiece, a pair of cutting blades for cutting the workpiece held by the holding element, the cutting blades being adapted to be rotated, a wear amount detecting element for detecting the amount of wear of each of the pair of cutting blades, and a control element. The control element is arranged to selectively cut the workpiece by both of the pair of cutting blades, or cut the workpiece by one of the pair of cutting blades. When the workpiece is to be cut by one of the pair of cutting blades, the control element compares the amounts of wear of the pair of cutting blades detected by the wear amount detecting element, and allows the cutting blade having a smaller amount of wear to cut the workpiece.

5 Claims, 3 Drawing Sheets

CUTTING DEVICE WITH A PAIR OF CUTTING BLADES AND ELEMENTS FOR DETECTING AND CONTROLLING WEAR OF THE CUTTING BLADES

FIELD OF THE INVENTION

This invention relates to a cutting device of the type which has a pair of cutting blades to be rotated, and which selectively cuts a workpiece by both of the pair of cutting blades, or cuts the workpiece by one of the pair of cutting blades.

DESCRIPTION OF THE PRIOR ART

In the production of a semiconductor chip, a plurality of rectangular regions are defined on the face of a semiconductor wafer, and a semiconductor circuit is disposed in each of the rectangular regions. The plurality of rectangular regions are defined by a plurality of cutting lines arranged in a lattice pattern, namely, a first set of cutting lines consisting of a plurality of cutting lines extending in a first direction, and a second set of cutting lines consisting of a plurality of cutting lines extending perpendicularly to the first direction. The semiconductor wafer is cut along each of the first set of cutting lines, and is further cut along each of the second set of cutting lines. In this manner, the rectangular regions are individually separated to produce semiconductor chips.

As a cutting device for cutting the semiconductor wafer along the cutting lines, a cutting device as disclosed in U.S. Pat. No. 6,345,616 or U.S. Pat. No. 6,726,526 is advantageously used, which has holding means for holding a workpiece, and a pair of cutting blades for cutting the workpiece held by the holding means. The pair of cutting blades are movable toward and away from each other, and are also movable toward and away from the holding means.

In cutting the semiconductor wafer by the above-mentioned cutting device, the semiconductor wafer is held on the holding means, and positioned such that the first set of cutting lines arranged on the semiconductor wafer extend in the direction of cutting. Also, the pair of cutting blades are positioned, as required, on two cutting lines of the first set of cutting lines. Then, the cutting blades are rotated, and the holding means is moved in the cutting direction to cut the semiconductor wafer along the two cutting lines. Then, the pair of cutting blades are positioned, as required, on other two cutting lines of the first set of cutting lines, and cutting is repeated. After the semiconductor wafer is cut along all cutting lines of the first set of cutting lines, the holding means is rotated 90 degrees so that the second set of cutting lines extend in the cutting direction. Then, the semiconductor wafer is cut along the second set of cutting lines in the same manner as is cut along the first set of cutting lines.

The minimum spacing between the pair of cutting blades in the foregoing cutting device is mechanically limited. On the other hand, the rectangular region is set to be considerably small, particularly, in the case of a compound semiconductor wafer comprising, for example, gallium arsenide (GaAs), gallium phosphide (GaP), or indium phosphide (InP). Thus, the spacing between the cutting lines of the semiconductor wafer is often so small as to be smaller than the minimum spacing between the pair of cutting blades. In such a case, cutting along some cutting lines can be performed by both of the pair of cutting blades, but cutting along some other cutting lines needs to be performed by only one of the pair of cutting blades. Even when the spacing between the cutting lines is larger than the minimum spacing between the pair of cutting blades, there may be a case where the number of the first set or second set of cutting lines is an odd number. In this case, cutting along the last one cutting line needs to be performed by only one of the pair of cutting blades.

With the conventional cutting device, if cutting is performed using only one of the pair of cutting blades, only one particular cutting blade is always operated. Thus, this one particular cutting blade is greatly worn compared with the other cutting blade. If the wear of the cutting blade proceeds, it is necessary to replace the cutting blade. In the conventional cutting device, there is need to replace each of the pair of cutting blades individually, instead of replacing the pair of cutting blades at the same time. Thus, the efficiency of cutting decreases owing to the replacement of the cutting blade. To avoid such a decrease in the cutting efficiency due to stoppage of the operation of the cutting device associated with the replacement of the cutting blade, the pair of cutting blades are replaced simultaneously. However, this simultaneous replacement results in the disadvantage that one of the cutting blades is fully worn and needs to be replaced, whereas the other cutting blade is not fully worn and continues to be usable, but has to be replaced. Consequently, the cost of cutting is increased.

SUMMARY OF THE INVENTION

It is a principal object of the present invention, therefore, to provide a novel and improved cutting device in which a pair of cutting blades wear at substantially the same pace, so that there is no need for wasteful replacement of the cutting blade not fully worn, but continuously usable, and the pair of cutting blades can be replaced simultaneously, whereby a decrease in the cutting efficiency can be avoided.

The inventor diligently conducted studies, and has found that when cutting is to be performed by only one of a pair of cutting blades, the amounts of wear of the pair of cutting blades are compared, and cutting is carried out by the cutting blade having a smaller amount of wear, whereby the above principal object can be attained.

That is, according to the present invention, as a cutting device for attaining the aforementioned principal object, there is provided a cutting device having holding means for holding a workpiece, a pair of cutting blades for cutting the workpiece held by the holding means, the cutting blades being adapted to be rotated, wear amount detecting means for detecting the amount of wear of each of the pair of cutting blades, and control means, the pair of cutting blades being movable toward and away from each other, and being also movable toward and away from the holding means, the cutting means being arranged to selectively cut the workpiece by both of the pair of cutting blades, or cut the workpiece by one of the pair of cutting blades, and wherein when the workpiece is to be cut by one of the pair of cutting blades, the control means compares the amounts of wear of the pair of cutting blades detected by the wear amount detecting means, and allows the cutting blade having a smaller amount of wear to cut the workpiece.

In preferred embodiments, the workpiece is a semiconductor wafer on whose face there are disposed a first set of cutting lines consisting of a plurality of cutting lines extending parallel in a first direction, and a second set of cutting lines consisting of a plurality of cutting lines extending perpendicularly to the first direction, and the spacing between the cutting lines of the first set of cutting lines and the spacing between the cutting lines of the second set of cutting lines are each smaller than the minimum spacing between the pair of cutting blades, and the control means compares the amounts of wear of the pair of cutting blades detected by the wear amount detecting means before the workpiece is cut along each of the cutting lines of the first set of cutting lines, and further compares the amounts of wear of the pair of cutting blades detected by the wear amount detecting means before the workpiece is cut along each of the cutting lines of the second set of cutting lines after cutting of the workpiece along each of the cutting lines of the first set of cutting lines is completed.

DETAILED DESCRIPTION OF THE PREFERRED EMBODIMENTS

The present invention will now be described in greater detail by reference to the accompanying drawings showing the preferred embodiments of a cutting device constructed according to the present invention.

Figure 1:
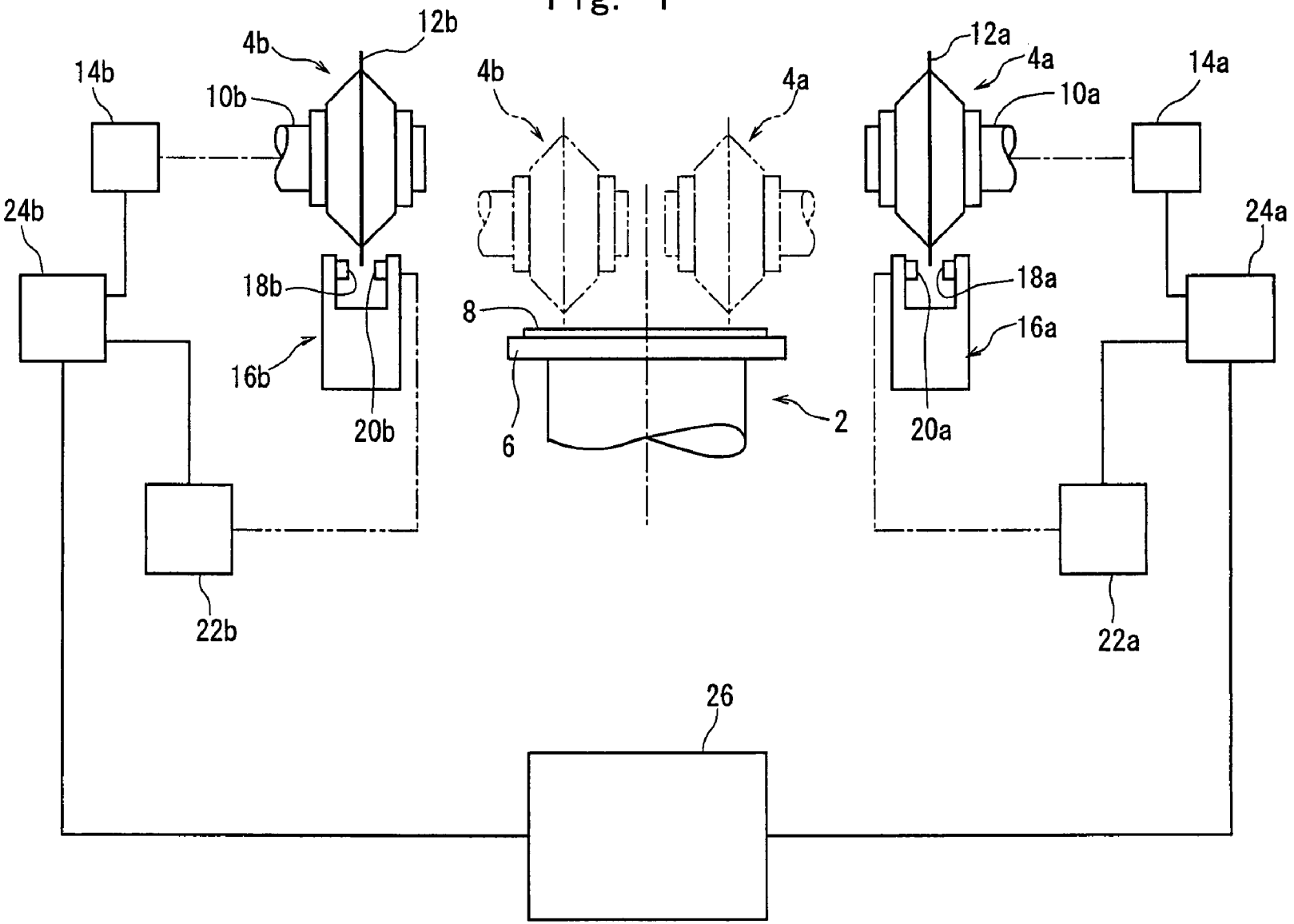
FIG. 1 is a schematic view showing main constituent elements of a cutting device constructed in accordance with the present invention.

FIG. 1 schematically shows the main constituent elements of a cutting device constructed in accordance with the present invention. The illustrated cutting device has a holding means 2 for holding a workpiece, and a pair of cutting means 4*a* and 4*b*. The holding means 2 has a chuck plate 6 disposed substantially horizontally. The chuck plate 6 is mounted so as to be rotatable about a central axis extending substantially vertically (in an up-and-down direction in FIG. 1) and to be movable to and fro in a cutting direction which is a direction perpendicular to the sheet face of FIG. 1. Suction means (not shown) is also annexed to the chuck plate 6, and a workpiece 8 such as a semiconductor wafer is vacuum attracted to the surface of the chuck plate 6.

The pair of cutting means 4*a* and 4*b* include rotating spindles 10*a* and 10*b*, respectively, which extend substantially horizontally in a right-and-left direction in FIG. 1. The rotating spindles 10*a* and 10*b* are mounted rotatably, and mounted so as to be movable in a right-and-left direction in FIG. 1 and to be movable in an up-and-down direction in FIG. 1. Cutting blades 12*a* and 12*b* each in the shape of a thin-walled annular plate are exchangeably fixed to front end portions of the rotating spindles 10*a* and 10*b*, respectively. The cutting blades 12*a* and 12*b* may each be a so-called electrodeposited blade having diamond grains dispersed in an electrodeposited metal.

The holding means 2 and the pair of cutting means 4*a* and 4*b* may be of the forms disclosed in the aforementioned U.S. Pat. No. 6,345,616 and U.S. Pat. No. 6,726,526. Thus, details of their features are to be referred to the U.S. Pat. No. 6,345,616 and U.S. Pat. No. 6,726,526, and their explanations will be omitted herein.

Referring to FIG. 1, rotating spindle height detecting means 14*a* and 14*b* and cutting blade detecting means 16*a* and 16*b* are annexed to the cutting means 4*a* and 4*b*, respectively. The rotating spindle height detecting means 14*a* and 14*b*, which can be constituted from optical detectors well known per se, detect the heights of the rotating spindles 10*a* and 10*b*, respectively. Each of the cutting blade detecting means 16*a* and 16*b* may be of a form well known per se which has a light emitting element 18*a* or 18*b* and a light receiving element 20*a* or 20*b*. Comparing means 22*a* and 22*b* for comparing the output voltages of the light receiving elements 20*a* and 20*b* with a reference voltage are connected to the light receiving elements 20*a* and 20*b*, respectively. As shown in FIG. 1, the cutting blades 12*a* and 12*b* are lowered, from above, to sites between the light emitting elements 18*a*, 18*b* and the light receiving elements 20*a*, 20*b*. When the amounts of light received by the light receiving elements 20*a* and 20*b* decrease to a predetermined reference value, accordingly, when the output voltages of the light receiving elements 20*a* and 20*b* decrease to a predetermined reference value, the comparing means 22*a* and 22*b* generate signals indicating that the lowermost ends of the cutting blades 12*a* and 12*b* are brought to predetermined positions between the light emitting elements 18*a*, 18*b* and the light receiving elements 20*a*, 20*b*.

Cutting blade wear amount detecting means 24*a* and 24*b* are also annexed to the cutting means 4*a* and 4*b*, respectively. The cutting blade wear amount detecting means 24*a* and 24*b* calculate the amounts of wear of the cutting blades 12*a* and 12*b* in accordance with the heights of the rotating spindles when the comparing means 22*a* and 22*b* have generated the signals. In detail, the differences between the heights of the rotating spindles when the comparing means 22*a* and 22*b* have generated the signals with respect to unused new cutting blades 12*a* and 12*b*, and the heights of the rotating spindles when the comparing means 22*a* and 22*b* have generated the signals with respect to used cutting blades 12*a* and 12*b* represent the amounts of wear of the cutting blades. Control means 26, which can be constituted from a suitable microprocessor, is further disposed in the cutting device.

Figure 2:
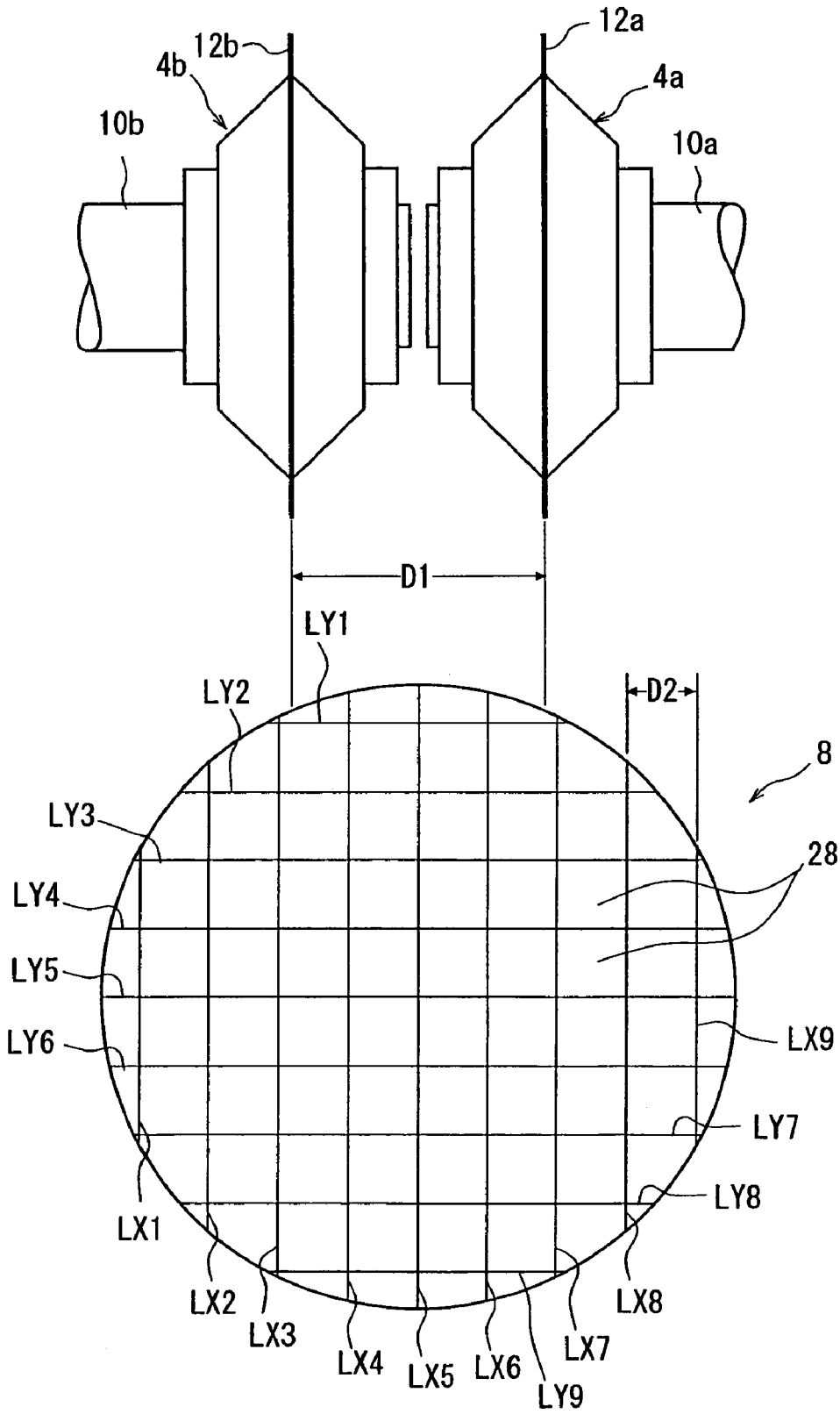
FIG. 2 is a schematic plan view showing a pair of cutting means and a workpiece in the cutting device of FIG. 1.

FIG. 2 shows the face of the workpiece 8 which is a compound semiconductor. On the face of the workpiece in the shape of a disk, there are disposed cutting lines arranged in a lattice pattern, namely, a first set of cutting lines consisting of a plurality of (nine in the drawing) cutting lines LX1 to LX9 extending parallel in a first direction (an up-and-down direction in FIG. 2), and a second set of cutting lines consisting of a plurality of (nine in the drawing) cutting lines LY1 to LY9 extending in a second direction (a right-and-left direction in FIG. 2) perpendicular to the first direction. A plurality of rectangular regions 28 are defined by these cutting lines. A semiconductor circuit is disposed in each of the rectangular regions 28.

In cutting the workpiece 8 along the cutting lines LX1 to LX9, the cutting blade 12*a* and/or the cutting blade 12*b* are (or is) aligned with a predetermined cutting line or predetermined cutting lines, along which cutting is to be performed, in the right-and-left direction in FIGS. 1 and 2. Also, the cutting blade(s) 12*a* and/or 12*b* are (or is) positioned at a predetermined cutting depth with respect to the workpiece 8. (For example, when the workpiece 8 is to be fully cut over its entire thickness, the lowermost edge(s) of the cutting blade(s) 12*a* and/or 12*b* are (or is) positioned at the lower surface of the workpiece 8.) Then, the rotating spindle(s) 10*a* and/or 10*b* are (or is) rotated at a high speed, and the holding means 2 is moved at a required speed in a cutting direction, namely, a direction perpendicular to the sheet face of FIG. 1 and an up-and-down direction in FIG. 2. When the workpiece 8 is to be cut along the cutting lines LY1 to LY9, the chuck plate 6 of the holding means 2 is rotated 90 degrees.

Because of the mechanical feature of the pair of cutting means 4*a* and 4*b*, the minimum spacing between the cutting blades 12*a* and 12*b* is limited to D1 as shown in FIG. 2. In the illustrated embodiment, the minimum spacing D1 is larger than the spacing D2 between the cutting lines of the first set of cutting lines LX1 to LX9. Thus, in cutting the workpiece along the cutting lines LX1 to LX3 and LX7 to LX9 of the first set of cutting lines LX1 to LX9, cutting can be performed using both of the cutting blades 12*a* and 12*b* at the same time. (For example, it is possible to perform cutting along the cutting line LX1 by the cutting blade 12*b* simultaneously with cutting along the cutting line LX9 by the cutting blade 12*a*, then perform cutting along the cutting line LX2 by the cutting blade 12*b* simultaneously with cutting along the cutting line LX8 by the cutting blade 12*a*, and then perform cutting along the cutting line LX3 by the cutting blade 12*b* simultaneously with cutting along the cutting line LX7 by the cutting blade 12*a*.) At the time of cutting along the cutting lines LX4 to LX6, it is necessary to perform cutting by only one of the cutting blade 12*a* and the cutting blade 12*b*. Cutting along the second set of cutting lines LY1 to LY9 is also the same as the cutting along the first set of cutting lines LX1 to LX9. In performing cutting by only one of the cutting blade 12*a* and the cutting blade 12*b*, it is important to compare the amounts of wear of the cutting blade 12*a* and the cutting blade 12*b*, and use the cutting blade with a smaller amount of wear.

Figure 3:
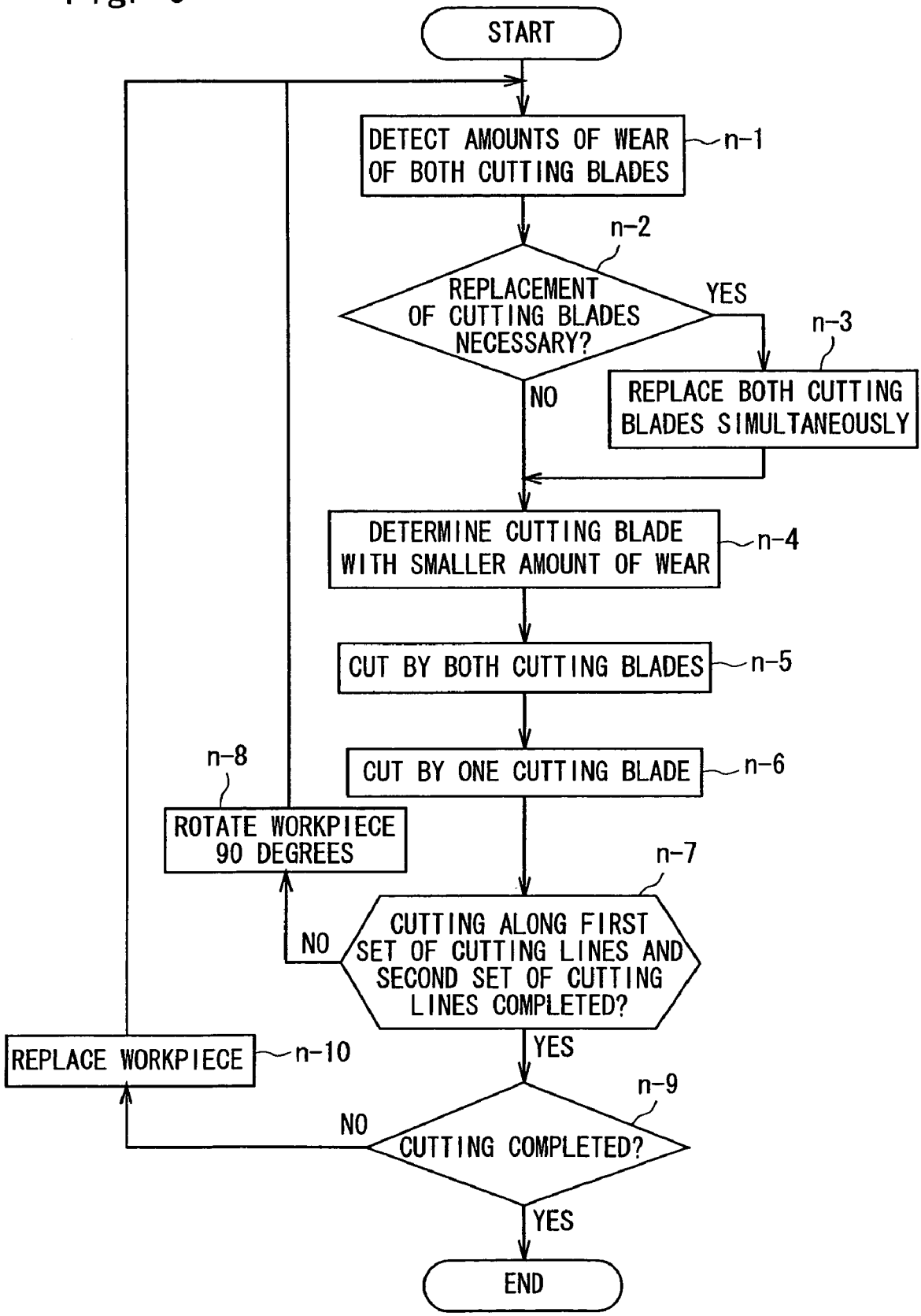
FIG. 3 is a flow chart showing the manner of operation control by the cutting device of FIG. 1.

A preferred manner of operation control by the control means 26 will be explained by reference to FIG. 3. In step n-1, the amounts of wear of the cutting blade 12*a* and the cutting blade 12*b* are detected. Then, the program proceeds to step n-2, determining whether the amount of wear of at least one of the cutting blade 12*a* and the cutting blade 12*b* reaches a predetermined value which indicates that the cutting blade concerned should be replaced. If the amount of wear of at least one of the cutting blade 12*a* and the cutting blade 12*b* reaches the predetermined value indicating the necessity for replacement, the program proceeds to step n-3, indicating on a suitable display means (not shown) that both of the cutting blade 12*a* and the cutting blade 12*b* should be replaced by new cutting blades. When both of the cutting blade 12*a* and the cutting blade 12*b* have been replaced by new cutting blades based on such an indication, the program proceeds to step n-4. If, in the above step n-2, neither the amount of wear of the cutting blade 12*a* nor the amount of wear of the cutting blade 12*b* reaches the predetermined value indicating the necessity for replacement, the program directly proceeds to step n-4. In step n-4, the amount of wear of the cutting blade 12*a* and the amount of wear of the cutting blade 12*b* are compared to determine the cutting blade with a smaller amount of wear. Then, the program proceeds to step n-5, in which the workpiece 8 is cut along the cutting lines LX1 to LX3 and LX7 to LX9 (or LY1 to LY3 and LY7 to LY9) by the simultaneous use of the cutting blade 12*a* and the cutting blade 12*b*. Then, the program proceeds to step n-6, in which the workpiece 8 is cut along the cutting lines LX4 to LX6 (or LY4 to LY6) with the use of the cutting blade 12*a* or 12*b* having a smaller amount of wear. Then, the program proceeds to step n-7, determining whether cutting along the second set of cutting lines LY1 to LY9 has ended in addition to cutting along the first set of cutting lines LX1 to LX9. If the cutting along the second set of cutting lines LY1 to LY9 has not ended, the program proceeds to step n-8 to rotate the chuck plate 90 degrees, accordingly, rotate the workpiece 8 ninety degrees. Then, the program returns to the aforementioned step n-1. If, in the above step n-7, cutting along the second set of cutting lines LY1 to LY9 has also ended, the program proceeds to step n-9, determining whether a workpiece 8 to be cut next is present or not, namely, whether cutting should be ended or not. If the workpiece 8 to be cut is present, the program proceeds to step n-10, in which the already cut workpiece 8 on the chuck plate 6 is changed to the workpiece 8 to be cut next. Then, the program returns to the aforementioned step n-1.

While the preferred embodiments of the cutting device constructed according to the present invention have been described in detail by reference to the accompanying drawings, it is to be understood that the invention should not be limited to such embodiments, but various changes and modifications may be made without departing from the scope of the invention.

What I claim is:

1. A cutting device comprising:

a holding member for holding a workpiece, a pair of rotating spindles, a pair of cutting blades of the same cross-sectional shape such that the cutting blades are interchangeable for cutting the workpiece held by said holding member, said cutting blades being rotated by said spindles, a wear amount detecting member for detecting an amount of wear of each of said pair of cutting blades, a control member, a rotating spindle height detecting member for detecting a height of each spindle of said pair of rotating spindles, a cutting blade detecting member corresponding to each cutting blade, each cutting blade detecting member including a light emitting element and a light receiving element with one of said cutting blades arranged therebetween, and a comparing member for detecting a predetermined position of each of said cutting blades by detecting variations in voltage representative of variations in amounts of light received by said light receiving elements at a time that the lowermost portion of said cutting blades obstructs light from said light emitting element to said light receiving element as said cutting blades are lowered, wherein said cutting blades are movable toward and away from each other, and are movable toward and away from said holding member, said control member is arranged to selectively cut the workpiece by both of said cutting blades, or by one of said pair of cutting blades, said wear amount detecting member calculates the amounts of wear of each of said cutting blades based on a difference between the height of their rotating spindles as detected by said rotating spindle height detecting member, and a predetermined position of each of said cutting blades as detected by said comparing member, and when the workpiece is to be cut by one of said pair of cutting blades, said control member selects whichever cutting blade has a smaller amount of wear as calculated by said wear amount detecting member to cut the workpiece.

2. The cutting device according to claim 1, wherein said workpiece is a semiconductor wafer provided with a plurality of cutting lines, and said control member causes selective and simultaneous cutting of the workpiece by both of the cutting blades along the cutting lines to which the cutting blades are aligned, and causes the workpiece to be cut such that each of the plurality of cutting lines is cut by either but not both of the cutting blades.

3. The cutting device according to claim 2, wherein said plurality of cutting lines includes a first set of cutting lines consisting of a plurality of cutting lines extending parallel in a first direction, and a second set of cutting lines consisting of a plurality of cutting lines extending perpendicularly to said first direction, and a spacing between the cutting lines of said first set of cutting lines and a spacing between the cutting lines of said second set of cutting lines are each smaller than a minimum spacing between said pair of cutting blades, and said control member compares the amounts of wear of said pair of cutting blades detected by said wear amount detecting member before the workpiece is cut along each of the cutting lines of said first set of cutting lines, and further compares the amounts of wear of said pair of cutting blades detected by said wear amount detecting member before the workpiece is cut along each of the cutting lines of said second set of cutting lines after cutting of the workpiece along each of the cutting lines of said first set of cutting lines is completed.

4. The cutting device according to claim 3, wherein the first and second cutting lines on said semiconductor wafer are present in odd numbers in said first and second directions, respectively, further wherein each of said first and second cutting lines in said first and second directions, respectively, is cut with the cutting blade having a smaller amount of wear.

5. The cutting device according to claim 1, wherein the wear amount detecting means determines the allowable range of amount of wear of the cutting blades to judge the necessity of changing cutting blades.

* * * * *